US006825248B2

(12) United States Patent
Melbouci et al.

(10) Patent No.: US 6,825,248 B2
(45) Date of Patent: Nov. 30, 2004

(54) PAPER COATING COMPOSITION WITH ENVIRONMENTALLY ACCEPTABLE FLUIDIZED POLYMER SUSPENSION

(75) Inventors: Mohand Melbouci, Wilmington, DE (US); L. Drake Walsh, Wilmington, DE (US)

(73) Assignee: Hercules Incorporated, Wilmington, DE (US)

( * ) Notice: Subject to any disclaimer, the term of this patent is extended or adjusted under 35 U.S.C. 154(b) by 0 days.

(21) Appl. No.: 10/236,161

(22) Filed: Sep. 6, 2002

(65) Prior Publication Data

US 2004/0048966 A1 Mar. 11, 2004

(51) Int. Cl.[7] ..... C08K 9/12; C08K 9/00

(52) U.S. Cl. ..... 523/207; 523/209; 523/210; 523/216

(58) Field of Search ..... 523/207, 209, 523/210, 216

(56) References Cited

U.S. PATENT DOCUMENTS 4,435,217 A * 3/1984 House ..... 106/181.1
4,566,977 A * 1/1986 Hatfield ..... 507/114
5,001,231 A * 3/1991 Zapico ..... 536/84
5,151,131 A * 9/1992 Burkhalter et al. ..... 106/822
5,278,203 A * 1/1994 Harms ..... 523/200
5,333,698 A * 8/1994 Van Slyke ..... 175/65
6,017,854 A * 1/2000 Van Slyke ..... 507/118

* cited by examiner

*Primary Examiner*—Matthew A. Thexton
(74) *Attorney, Agent, or Firm*—David Edwards

(57) ABSTRACT

This invention provides a light white mineral oil-based fluidized polymer suspension (FPS) composition for use as a rheology modifier in paper coatings. It has been found that by using a selected composition of low viscosity oil as a carrier, high solids content and environmental friendly fluidized polymer suspensions of water soluble cellulose derivatives, synthetic water soluble polymers, guar gum and derivatives, starch and derivatives and mixtures thereof, can be prepared. The FPS of the present invention was found to provide unexpected beneficial performance properties when added as a rheology modifier to a paper coating containing standard binders, pigment, and water. The oil-based fluid polymer suspension composition of the present invention for use as a rheology modifier in the paper coating comprises: a hydrophilic polymer, b) an organophilic clay, c) a surfactant stabilizer, and d) a light white mineral oil having selected properties.

51 Claims, No Drawings

PAPER COATING COMPOSITION WITH ENVIRONMENTALLY ACCEPTABLE FLUIDIZED POLYMER SUSPENSION

FIELD OF THE INVENTION

This invention relates to a non-aqueous fluidized polymer suspension for use as a rheology modifier in paper coatings. More particularly, this invention is directed to the use of an environmentally acceptable fluidized polymer suspension of carboxymethylcellulose in a light white mineral oil for use in paper coating applications.

BACKGROUND OF THE INVENTION

Carboxymethylcellulose (CMC) is well known for its industrial use in paper coatings. CMC has been used in its dry form as a direct additive for paper coating formulations, although this usage has mainly been limited in the past to low molecular weight, i.e., low viscosity, CMC types. This limitation is due to the fact that higher molecular weight CMC dry powder tends to form lumps that are problematic to dissolve when added to paper coatings. In fact, even lower molecular weight CMC powder can form lumps when added to paper coatings without special precautions. Also, another difficulty with dry powdered CMC handling is dusting that can cause health hazards such as slippery floors and respiratory problems due to breathing the polymer particles.

Hence, in order to overcome such problems with dry powdered CMC, the paper coating industry has in places adopted the use of CMC liquid suspensions dispersed in fatty acid organic liquid carrier. Other general standard practice in the coating industry is to use low molecular weight CMC first dissolved in water to form a base solution before it is incorporated into paper coatings.

The use of CMC powder to prepare dilute aqueous solutions also creates problems. One such problem of using CMC solutions is that first the polymer has to be properly dissolved in water. This procedure suffers the limitation in that it is labor intensive and time consuming and highly viscous aqueous CMC solutions are difficult to prepare, store, and handle. Another problem with CMC aqueous solutions is that there is a limitation on how much CMC can be dissolved into this solution due to excessive viscosity development. In addition, another problem with these aqueous solutions is that numerous undissolved gel lumps can often form due to the tendency of CMC to lump when added to dissolution water. These gel lumps has to be removed either by stirring for a prolonged period of time or by physically removing them before addition to the paper coating. Special mixing equipment sometimes has to be used in order to prepare concentrated CMC solutions in water because of the highly viscous nature of these solutions.

Because of the problems with dry powder and aqueous solutions of CMC, fluid polymer suspensions were developed and are currently being used commercially to deliver these polymers to paper coating compositions. The use of fatty acid liquid carrier as a vehicle for these suspensions was a significant improvement over prior art handling and performance of dry CMC for paper coatings thickening applications. However, the use of fatty acid as a CMC suspension medium has historically been problematic as well. The manufacture, transport, and application of CMC fluid polymer suspensions based upon fatty acid has proven to be difficult. Instability, high viscosity, marginal fluidity, and/or residue formation have been observed with these products. Furthermore, some of these fatty acid based CMC fluidized polymer suspensions or other suspensions of CMC have contained less environmentally favorable ingredients.

The pollution from paper making plants has reportedly endangered fish and plant life in bodies of water near papermills and may threaten the ecological balance of these systems. For this reason in the past few years, legal sanctions and environmental restrictions in the paper making industry have required changes in chemical usage in papermaking and coatings systems. In this category, water based fluid systems are most preferred assuming all chemicals contained in the fluid systems exhibit low toxicity and high biodegradability. The chemicals used in these fluid systems are regarded as separate components that should meet the environmental regulations for nonpolluting paper coating fluids.

In addition to the use of fatty acid as a carrier for fluid suspensions of CMC, other liquid carriers cited in the prior art include mineral oil, kerosene, diesel fuel, and glycols. These hydrocarbon-based solvents that are commercially available may not be acceptable environmentally by most of the paper industry.

U.S. Pat. No. 5,001,231 (J. Zapico) discloses an invert emulsion polysaccharide slurry for industrial use containing (1) diesel, mineral, or paraffin oil, (2) surfactant, (3) water, (4) organophilic clay, and (5) a polysaccharide (CMC is disclosed).

U.S. Pat. No. 5,151,131 (J. Burkhalter et al.) discloses an anhydrous fluidized polymer suspension for use as a liquid fluid loss control additive for an aqueous well cement composition containing (1) liquid hydrocarbon (e.g., kerosene, diesel oil, light white mineral oils, and aliphatic hydrocarbon oils), (2) surfactant, (3) organophilic clay, and (4) a hydrophilic polymer, e.g., CMC.

U.S. Pat. No. 5,096,490 (C. L. Burdick) discloses a fluid polymer suspension for use in paper coatings containing (1) at least one water soluble polymer such as CMC, dispersed and suspended in (2) a fatty acid, and (3) an organoclay stabilizing agent, and (4) an oil-in-water emulsifier.

U.S. patent application Ser. No. 09/717884 discloses an oil-based fluid polymer suspension for use in oil or gas well servicing fluids containing a) a hydrophilic polymer, b) an organophilic clay, c) a stabilizer, and d) a white medicinal oil that i) has a low viscosity, ii) has no aromatic content, iii) has a high flash point, iv) has a low pour point, v) is food contact approved, vi) is non-toxic, and vii) is biodegradable, whereby this FPS composition is environmentally acceptable for use in offshore oil field servicing fluids.

U.S. Pat. Nos. 5,494,509, 5,725,648, and 6,030,443 disclose paper coating compositions that use polysaccharides.

SUMMARY OF THE INVENTION

The present invention is directed to a paper coating composition comprising a pigment, a binder, water, other standard paper coating adjuvants, and a light white mineral oil-based fluidized polymer suspension composition for use as a rheology modifier in the paper coating comprising a hydrophilic polymer, an organophilic clay, a stabilizer and a specific type of light white mineral oil. The light white mineral oil component of the present invention must exhibit a relatively low viscosity, have low aromatic content, exhibit a relatively high flash point, exhibit a low pour point, be food-contact approved, be non-toxic, and be biodegradable, thereby rendering the complete FPS composition environmentally acceptable for use in paper coatings.

DETAILS OF THE INVENTION

In accordance with this invention, it has been surprisingly found that by using light white mineral oil as a carrier, high solids content and environmental friendly anhydrous fluidized polymer suspensions of xanthan gum, cellulose ethers, guar gum and derivatives thereof can be prepared. It was unexpectedly found that the use of this system improves handling and ease of use as opposed to the use of fatty acid in CMC suspensions. Furthermore, it was unexpectedly found that the light white mineral oil-based CMC suspensions exhibited significantly improved storage stability as compared to the fatty acid CMC suspensions of the prior art. Depending upon the type of the polymer used, stable and flowable fluidized polymer suspensions containing from 40% to 55% active content can be prepared. Synthetics such as polyacrylamide and polyacrylate may also be suspended in this system.

Typically, the fluidized polymer suspension of the present invention contains:

| Ingredient | Type | Preferred/ Trademark | Concentration, wt % |
|---|---|---|---|
| Liquid carrier | Light White mineral oil | Ecolane 130 | 43–49 |
| Suspending agent | Organophilic clay | Tixogel MP100 | 3.0–3.5 |
| Stabilizer | Sorbitan trioleate ester | Montane 85 | 0.1–0.6 |
| | Ethoxylated Sorbitan trioleate ester | Montanox 85 | 2.5–3.5 |
| Polymer | Water-soluble Cellulose derivative ether, xanthan gum, Guars, etc., optionally synthetics | CMC, HEC, Guar | 45–55 |

Liquid Carrier

From a Regulatory (USA) point of view, the light white mineral oils used in the present invention have been approved for use for personal contact and are widely used in pharmaceutical, cream denture adhesive and cosmetic formulations. They are listed in the International Nomenclature for Cosmetics Ingredients (I.N.C.I.) under designation "Paraffinum Liquidum". They comply with many pharmacopoeia and FDA regulations.

In accordance with this invention, any light white mineral oil, such as medicinal oils, food grade oils (FDA) or technical white oils, can be used as long as the oil meets the following criteria:

Viscosity, in the range of 2–17 cSt ($mm^2$/sec) at 40° C.,

Aromatics content, below 100 ppm,

Flash point, above 100° C.,

Pour point, below 0° C.,

Compliance with food contact approved regulation,

Low Aquatic Toxicity, and

High Biodegradability.

In accordance with this invention, the preferred liquid carrier of the FPS composition is selected from the group of light white medicinal oils. The liquid carrier of the FPS composition has a lower limit amount of about 40 weight percent based on the total weight of the composition. The upper limit amount of the liquid carrier is 80 weight percent, preferably 60 weight percent, and more preferably 50 weight percent.

The preferred commercially available light white mineral oils are Carnation® oil from Witco, Peneteck® and Drakeol® oils from Penreco, Marcol® 52 oil from Exxon, Ondina® 3 oil from Shell, and Ecolane® 130 oil from TOTALFINAELF.

With regard to these requirements, the white medicinal oil "Ecolane® 130" is preferred. It is reported to be free of aromatics (any content below 100 PPM is considered as trace), biodegradable, and non-toxic. Detailed information regarding Ecolane® 130 is as follows:

| | |
|---|---|
| Flash point | 135° C. |
| Aromatics content | Typically 30 ppm |
| Benzene content | 0 ppm |
| Viscosity @ 40° C. | 4.1 $mm^2$/sec |
| Pour point | −20° C. |
| German Foodstuff | |
| BGVV | Pass |
| Liquid paraffin test | Pass |
| German pharmacopoeia | |
| DAB96 | Pass |
| USA, Food & Drugs | |
| 21 CFR chl § 178.3620 | Pass (approved for food contact) |
| 21 CFR chl § 176.170 and § 176.180 | Pass |

Toxicity and Ecotoxicity Summary of Ecolane 130

| Tox/Ecotox | Tests | Norm | Laboratory | Ecolane 130 |
|---|---|---|---|---|
| Ecotoxicity | Aerobic biodegradation | OECD306 Sea-water | SINTEF/Norway | Readily biodegradable 28 days 76.5% |
| Ecotoxicity | Aerobic biodegradation | OECD301F Fresh-water | HCSG/CEFIC | Readily biodegradable 28 days >60% |
| Ecotoxicity | Fish Rainbow Trout | OECD GL203 | HCSG/CEFIC | >100 mg/l |
| Solubility | Solubility In water | Internal method | TOTAL-PFS | <1 mg/l |
| Toxicity | Acute dermal Irritation/corrosion | OECD GL 404 | CIT/France | Not irritating No classification |
| Toxicity | Acute eye Irritation/corrosion | OECD CL 405 | CIT/France | Not irritating No classification |
| Aquatic Toxicity | Algae *Skeletonema Costatum* | ISO/DIS 10253 | SINTEF/Norway | 48h EC50: >100000 mg/l 72h EC90: >100000 mg/l |
| Aquatic Toxicity | Crustacean *Acartia tonsa* | ISO TC 147/SC5/WG2 | SINTEF/Norway | 48h LC50: 22650 mg/l 48h LC100/LC90: 48398 mg/l |
| Aquatic | Sediment reworker | | SINTEF/Norway | 10d LC50: 1211 mg/l |

-continued

Toxicity and Ecotoxicity Summary of Ecolane 130

| Tox/Ecotox | Tests | Norm | Laboratory | Ecolane 130 |
|---|---|---|---|---|
| Toxicity | *Corophium volutator* | | | 10d LC100/LC90: 5250 mg/l |
| Bioaccumulation | | OECD 317 | | Not soluble in water Log Pow >3 |

Suspending Agents

Organophilic clays are employed as a stabilizer for liquid fluidized polymer suspensions of the present invention. Organophilic clay is a modified montmorillonite designed for use in organic systems containing from low to high polarity solvents or solvent blends. It provides reproducible viscosity and thixotropy development, a high degree of sag control and prevents solid particles from settling.

In accordance with this invention, the organophilic clay suspending agent of the FPS composition has a lower limit amount of about 0.5 weight percent based on the weight of the fluidized polymer suspension, preferably about 1.0 weight percent, and more preferably 2.0 weight percent. The upper limit amount of the suspending agent is 5.0 weight percent, preferably 4.0 weight percent, and more preferably 3.4 weight percent.

Examples of organophilic clays are Tixogel® product, available from United catalyst Inc. (Louisville, Ky.), Bentone® product, available from Rheox company (Hightestown, N.J.) and Claytone® product, available from Southern Clay Products (Gonzalez, Tex.). The preferred organophilic clays are self-activating and do not require a polar activator. In accordance with this invention, the most preferred organophilic clay is the Tixogel® MP100 product.

Stablizers

In fluidized polymer suspension of the present invention, surfactants are employed as a stabilizing/emulsifying agent. The non-ionic surfactant(s) suitable for use in the FPS composition of this invention has a hydrophilic-lipophilic balance (HLB) of from about 1 to about 14, preferably from about 1.4 to about 11. The term "HLB" is well known in the prior art and is defined as "hydrophile-lipophile balance". The balance is of the size and magnitude of the hydrophilic (water loving) and the lipophilic (oil loving) groups. A low HLB numbered surfactant is lipophilic while a high HLB numbered surfactant is hydrophilic. The HLB system allows one to assign a number to the ingredients that are to be emulsified. Then, the surfactants that are to be selected should have approximately this same number.

In accordance with this invention, the stabilizing agent of the FPS composition has a lower limit amount of about 0.5 weight percent based on the weight of the fluidized polymer suspension, preferably about 2.0 weight percent, and more preferably 3.0 weight percent. The upper limit amount of the suspending agent is 5.0 weight percent, preferably 4.0 weight percent, and more preferably 3.4 weight percent.

Examples of surfactant stabilizers that are used in this invention are non-ionic, such as sorbitan esters, ethoxylated sorbitan esters (e.g., polyethoxyethylene sorbitan esters), ethoxylated fatty alcohols, and ethoxylated fatty acids. The preferred surfactants are sorbitan esters or ethoxylated sorbitan esters or mixtures thereof. The most preferred surfactant is a blend of sorbitan trioleate/ethoxylated sorbitan trioleate such as Montane® 85/Montanox® 85 products, available from SEPPIC (Paris, France) and Sorban® AO/Sorbanox® AO products, available from Witco (Saint Pierre-les-Elboeuf, France) and Tween 85/Span 85 from Uniquema (Wilmington, Del.).

In accordance with the present invention, the fluidized polymer suspensions do not contain any nonylphenol ethoxylate (NPES) surfactants, since these would be considered environmentally less permissible under some governmental regulations.

HYDROPHILIC WATER-SOLUBLE/WATER-SWELLABLE POLYMERS

In accordance with this invention, most polysaccharides used in paper coatings can be suspended in the present invention. These include polysaccharides such as water soluble cellulose derivatives, starch/starch derivatives, and guar gum and its derivatives. The cellulose derivatives include carboxymethylcellulose (CMC), hydroxyethylcellulose (HEC), methylhydroxypropylcellulose (MHPC), carboxymethylhydroxyethylcellulose (CMHEC). The guar gum and guar gum derivatives include straight guar (Guar), carboxymethylguar (CMG), hydroxypropylguar (HPG), carboxymethylhydroxyethylguar (CMHEG) and cationic guar (Cat. Guar). The starch derivatives include carboxymethylstarch, hydroxyethylstarch, hydroxypropylstarch, carboxymethylhydroxypropylstarch, oxidized starch, and pregelatinized starch.

In accordance with this invention, the hydrophilic polymer of the FPS composition can have a solids content substantially higher than in the prior art fluid polymer systems because of the unique properties of the white medicinal oil carrier. The polymer can be incorporated into the composition having a lower limit amount of typically about 20–60 weight percent based on the total weight of the composition, preferably about 40 weight percent, and more preferably 45 weight percent. The upper limit amount of the solvent carrier is 80 weight percent, preferably 60 weight percent, and more preferably 50 weight percent.

In response to the above requirements concerning the EPA Method 1664 regarding Ecolane® 130 product, TOTALFINAELF, the manufacturer of this product confirmed that Ecolane® 130 product is entirely extracted with "N-Hexane" an environmentally acceptable extractant. TOTALFINAELF further guarantees that the Ecolane® 130 product is a blend of alcanes and as such is not adsorbed by silica gels. As a result, SGT-HEM (Silica Gel Treated—Hexane Extractable Material) is below the detection limit of 5 mg/l, which largely meets the EPA specifications.

Based on this information, fluidized polymer suspensions in accordance with this invention can be considered as environmentally friendly suspension that can be used in paper coatings.

The following examples will serve to provide specific illustrations of the practice of this invention but they are not intended in any way to be limiting the scope of this invention.

EXAMPLE 1

A liquid CMC suspension in white medicinal oil of the present invention was prepared by first combining 48 parts by weight Ecolane 130 white medicinal oil with 3.4 parts by weight Tixogel MP 100 organoclay (Sud-Chemie) and heating to >45° C. to activate the clay. The clay was then stabilized by adding 0.4 part by weight Montane 85 product (Seppic), 3.0 parts by weight Montanox 85 product (Seppic) to the mixture. Finally, into this mixture 45 parts by weight CMC was added with high speed Warring blender mixing to form the suspension.

For comparison a liquid CMC suspension of the prior art U.S. Pat. No. 5,096,490 was prepared, utilizing the same lot of CMC-9M31X, in which 45 weight % of CMC was suspended in 42 parts by weight of Pamak 4 fatty acid (Hercules Incorporated), 10 parts of Tween 80 surfactant (Uniquema) and 3 parts by weight of Claytone AF organoclay (Southern Clay Products).

Each of these CMC suspensions was used to thicken a separate paper coating formulation to a Brookfield viscosity of about 2100 cps at ambient temperature. The coating formulation is shown in Table 1. Standard physical measurements of the two comparative coating samples were then determined including water retention and Hercules Hi-Shear viscosity.

These tests showed that the water retention value of the medicinal oil suspension of the present inventions was better that the prior art fatty acid FPS. The Hercules Hi-Shear Viscosity of the paper coating that contained the medicinal oil of the present invention was significantly lower than the prior art CMC FPS. These results are shown in Table 2.

These findings represent an improvement in paper coating performance of the present invention as compared to U.S. Pat. No. 5,096,490.

TABLE 1

COATING Formulation

| Ingredients | Dry Parts |
|---|---|
| OMYA ® Hydrocarb 90 ($CaCO_3$) | 40 |
| Huber ® Hydragloss 90 (kaolin clay) | 60 |
| Latex | 12 |
| Dispersant | 0.1 |
| Adjusted pH to 8.5 | |
| Solids | 67% |

TABLE 2

WET COATING PROPERTIES

| THICKENER | DOSAGE | BV | GWR | HHSV |
|---|---|---|---|---|
| Fatty Acid Based | 0.81 wet | 2380 | 131 | 89/59 |
| CMC-7H3SX | | | | 51/50 |
| White Medicinal Oil Based | 0.86 wet | 2040 | 127 | 70/51 |
| CMC-7H3SX9T | | | | 45/42 |

Dosage wet parts thickener per 100 parts pigment
BV Brookfield viscosity in cps at 100 rpm, #5 spindle
GWR gravimetric water retention expressed as grams water lost into base sheet per meter$^2$
HHSV Hercules high shear viscosity in cps at 2,200 & 4,400 rpm, 1$^{st}$ and 2$^{nd}$ pass, E bob

EXAMPLE 2

The two above FPS samples from Example 1 were compared for flow behavior by means of an AFNOR#6 drainage cup. In this test a given CMC FPS is timed for a given volume of material to flow out of a defined cup configuration. It was measured that CMC fatty acid suspension exhibited AFNOR #6 cup flow times of 90–225 seconds as typical values. By comparison the CMC in medicinal oil exhibited flow times of 18–30 seconds.

It was found in these tests that the CMC FPS in medicinal oil exhibited a shorter flow period versus the CMC fatty acid FPS of the prior art. Since flowability is known to be a critical property of liquid products, the instant invention in this Example demonstrates its improved flowability over the prior art.

EXAMPLE 3

A sample of a commercial product Admiral 6265PR (carrier is fatty acid based) received from Hercules Incorporated was stored in an oven at 90° C. for 24 hours. As a test case, the same size quantity of a sample of the present invention from Example 1 was stored in the same oven for this same length of time and at the same temperature. The two samples were then added to dilution water at a dilution ratio of 2 parts by weight FPS in 98 parts by weight of water, and these solutions were then checked for the presence of insoluble material by screening through a 100 U.S. mesh screen.

It was observed that the commercial product Admiral 6265PR exhibited a large number of insoluble gel particles on top of the 100 mesh screen whereas the present invention was a smooth solution that passed entirely through the screen. This example demonstrates heat stability of the present invention as compared to a commercial FPS of CMC.

EXAMPLE 4

A generic paper coating master batch was prepared (Table A) below. In the first step, the pigments were made into an aqueous slurry. Next, dispersant (sodium polyacrylate) was added to the slurry at 0.1 active parts based on pigment as a dispersion aid. After 15 minutes of mixing, 1 part of lubricant (calcium stearate) and 11 parts of styrene butadiene latex were added to the slurry. The pH was then adjusted with ammonia to 9.0.

This master batch was decanted into 500 gram aliquots. Into each aliquot, a fluidized polymer suspension was added; 45% suspension of cationic guar, carboxymethylcellulose, and hydroxyethylcellulose were formed. The coating was thickened to a constant Brookfield viscosity. Wet coating testing (Table B) included water retention (GWR) and high shear rheology (HHSV) was run on these samples. These coatings were then applied to a 62 pound base sheet at approximately 10 pounds per 3000 square feet of paper using a laboratory Dow® coater (Serial #079, Type 89B-SS). Coated paper sheets were tested (Table C) for brightness using a Diano® S-4 Brightness Tester and Colorimeter, gloss using a Macobeth® Lab Gloss meter with a 75° C. Labgloss Head, and porosity using a tmi® Monitor/Print-Surf tester.

TABLE A

COATING Formulation

| Ingredients | Dry Parts |
|---|---|
| OMYA ® Hydrocarb 90 (CaCO3) | 40 |
| Huber ® Hydragloss 90 (kaolin clay) | 60 |
| Latex | 11 |
| Lubricant | 1.0 |
| Dispersant | 0.1 |
| Adjusted pH to 9.0 | |
| Solids | 64.6% |

TABLE B

| WET COATING PROPERTIES | | | | |
|---|---|---|---|---|
| THICKENER | DOSAGE | BV | GWR | HHSV |
| White Medicinal Oil Based Cationic Guar | 0.19 | 3030 | 260 | 74/56<br>43/39 |
| White Medicinal Oil Based Natrosol ® 250 G | 0.44 | 2510 | 97 | 80/62<br>41/36 |
| White Medicinal Oil Based CMC-9M31X | 0.24 | 2300 | 87 | 56/41<br>40/36 |

Dosage wet parts thickener per 100 parts pigment
BV Brookfield viscosity in cps at 100 rpm, #5 spindle
GWR gravimetric water retention expressed as grams water lost into base sheet per meter$^2$
HHSV Hercules high shear viscosity in cps at 2,200 & 4,400 rpm, 1$^{st}$ and 2$^{nd}$ pass, E bob

TABLE C

| COATED SHEET PROPERTIES | | | | |
|---|---|---|---|---|
| | BRIGHT- | | POROSITY | |
| THICKENER | NESS | GLOSS | Calendered | Uncalendered |
| White Medicinal Oil Based Cationic Guar | 80.3 | 63.9 | 28.4 | 255.7 |
| White Medicinal Oil Based Natrosol ® 250 G | 82.5 | 68.9 | 49.5 | 262.9 |
| White Medicinal Oil Based CMC-9M31X | 82.7 | 60.8 | 40.9 | 270.4 |

All values are the average of 20 readings, 10 per sheet.
Paper calendered at 1100 pounds per linear inch with two passes.

What is claimed:

1. A paper coating composition comprising a pigment, a binder, and an oil-based fluidized polymer suspension (FPS) composition for use as a rheology modifier in the paper coating comprising a) a hydrophilic water-soluble polymer, b) self-activating orgariophilic clay, c) a non-ionic surfactant stabilizer excluding nonylphenols, and d) a non-aqueous non-toxic light, biodegradable white mineral oil wherein the composition is environmentally friendly and exhibits a stable low Brookfield viscosity of 3000 cps or less in a non-diluted state, but when diluted in water or paper coating is capable of providing a controlled thickening effect to produce a target viscosity and other desired properties.

2. The paper coating composition of claim 1, wherein the lower limit amount of the light white mineral oil is about 20-wt % based on the total weight of the FPS composition.

3. The paper coating composition of claim 1, wherein the lower limit amount of the light white mineral oil is about 30-wt % based on the total weight of the FPS composition.

4. The paper coating composition of claim 1, wherein lower limit amount of the light white mineral oil is about 40-wt % based on the total weight of the FPS composition.

5. The paper coating composition of claim 1, wherein the upper limit amount of the light white mineral oil is about 60-wt % based on the total weight of the FPS composition.

6. The paper coating composition of claim 1, wherein the upper limit amount of the light white mineral oil is about 55-wt % based on the total weight of the FPS composition.

7. The paper coating composition of claim 1, wherein the upper limit amount of the light white mineral oil is about 50-wt % based on the total weight of the FPS composition.

8. The paper coating composition of claim 1, wherein the light white mineral oil has a Kinetic viscosity at 40° C. lower limit of 2 $mm^2$ $sec^{-1}$ (2 cSt.).

9. The paper coating composition of claim 1, wherein the light white mineral oil has a Kinetic viscosity at 40° C. lower limit of 5 cSt.

10. The paper coating composition of claim 1, wherein the light white mineral oil has a Kinetic viscosity at 40° C. lower limit of 7.5 cSt.

11. The paper coating composition of claim 1, wherein the light white mineral oil has a Kinetic viscosity at 40° C. upper limit of 17 cSt.

12. The paper coating composition of claim 1, wherein the light white mineral oil has a Kinetic viscosity at 40° C. upper limit of 14 cSt.

13. The paper coating composition of claim 1, wherein the light white mineral oil has a Kinetic viscosity at 40° C. upper limit of 10 cSt.

14. The paper coating composition of claim 1, wherein the light white mineral oil has an aromatic content upper limit of 100 ppm.

15. The paper coating composition of claim 1, wherein the light white mineral oil has an aromatic content of less than 50 ppm.

16. The paper coating composition of claim 1, wherein the light white mineral oil has an aromatic content of less than 30 ppm.

17. The paper coating composition of claim 1, wherein the light white mineral oil has a flash point above 100° C.

18. The paper coating composition of claim 1, wherein the light white mineral oil has a pour point lower limit of less than −5° C.

19. The paper coating composition of claim 1, wherein the organophilic clay suspending agent is a modified montmorillonite.

20. The paper coating composition of claim 19, wherein the organophilic clay suspending agent is treated in such a way that its dispersion and gellation is self activated.

21. The paper coating composition of claim 19, wherein the dispersion and gellation of the organophilic clay suspending agent is aided by polar solvents.

22. The paper coating composition of claim 19, wherein the organophilic clay suspending agent has a lower limit of about 0.5 wt % based on the total weight of the FPS composition.

23. The paper coating composition of claim 19, wherein the organophilic clay suspending agent has a lower limit of about 1.0 wt % based on the total weight of the FPS composition.

24. The paper coating composition of claim 19, wherein the organophilic clay suspending agent has a lower limit of about 2.0 wt % based on the total weight of the FPS composition.

25. The paper coating composition of claim 19, wherein the organophilic clay suspending agent has an upper limit of about 6.0 wt % based on the total weight of the FPS composition.

26. The paper coating composition of claim 19, wherein the organophilic clay suspending agent has an upper limit of about 4.0 wt % based on the total weight of the FPS composition.

27. The paper coating composition of claim 19, wherein the organophilic clay suspending agent has an upper limit of about 3.4 wt % based on the total weight of the FPS composition.

28. The paper coating composition of claim 1, wherein the stabilizing agent is a non-ionic surfactant.

29. The paper coating composition of claim 28, wherein the non-ionic surfactant has a lower limit of about 0.5 wt % based on the total weight of the FPS composition.

30. The paper coating composition of claim 28, wherein the non-ionic surfactant has a lower limit of about 2.0 wt % based on the total weight of the FPS composition.

31. The paper coating composition of claim 28, wherein the non-ionic surfactant has a lower limit of about 3.0 wt % based on the total weight of the FPS composition.

32. The paper coating composition of claim 28, wherein the non-ionic surfactant has an upper limit of about 6.0 wt % based on the total weight of the FPS composition.

33. The paper coating composition of claim 28, wherein the non-ionic surfactant has an upper limit of about 4.0 wt % based on the total weight of the FPS composition.

34. The paper coating composition of claim 28, wherein the non-ionic surfactant has an upper limit of about 3.4 wt % based on the total weight of the FPS composition.

35. The paper coating composition of claim 28, wherein the non-ionic surfactant is selected from the group consisting of sorbitan esters, ethoxylated sorbitan esters, ethoxylated fatty alcohols, ethoxylated fatty acids, and mixtures thereof.

36. The paper coating composition of claim 28, wherein the non-ionic surfactant is selected from the group consisting of polyethoxyethylene sorbitan esters.

37. The paper coating composition of claim 28, wherein the non-ionic surfactant is selected from the group consisting of sorbitan esters, ethoxylated sorbitan esters and mixtures thereof.

38. The paper coating composition of claim 37, wherein the non-ionic surfactant is a blend of sorbitan trioleate and ethoxylated sorbitan trioleate.

39. The paper coating composition of claim 1, wherein the lower limit amount of the hydrophilic polymer is about 40 wt % based on the total weight of the FPS composition.

40. The paper coating composition of claim 1, wherein the lower limit amount of the hydrophilic polymer is about 45 wt % based on the total weight of the FPS composition.

41. The paper coating composition of claim 1, wherein the upper limit amount of the hydrophilic polymer is about 80 wt % based on the total weight of the FPS composition.

42. The paper coating composition of claim 1, wherein the upper limit amount of the hydrophilic polymer is about 55 wt % based on the total weight of the FPS composition.

43. The paper coating composition of claim 1, wherein the upper limit amount of the hydrophilic polymer is about 50 wt % based on the total weight of the FPS composition.

44. The paper coating composition of claim 1, wherein the hydrophilic polymer is a synthetic polymer.

45. The paper coating composition of claim 1, wherein the hydrophilic polymer is a combination of a polysaccharide and a synthetic polymer.

46. The paper coating composition of claim 45, wherein the polysaccharide is selected from the group consisting of cellulose ethers, biopolymers, starch and starch derivatives, guar gum and guar derivatives, and mixtures thereof.

47. The paper coating composition of claim 46, wherein the polysaccharide is a cellulose ether that is selected from the group consisting of carboxymethylcellulose (CMC), hydroxyethylcellulose (HEC), carboxymethylhydroxyethylcellulose (CMHEC), polyanionic cellulose (PAC), and mixtures thereof.

48. The paper coating composition of claim 46, wherein the polysaccharide is a guar gum derivative that is selected from the group consisting of carboxymethylguar (CMG), hydroxypropylguar (HPG), carboxymethylhydroxyethylguar (CMHEG), cationic guar (Cat. Guar), and mixtures thereof.

49. The paper coating composition of claim 46, wherein the polysaccharide is a starch derivative that is selected from the group consisting of carboxymethylstarch, hydroxyethylstarch, hydroxypropylstarch, and mixtures thereof.

50. The paper coating composition of claim 46, wherein the polysaccharide is a biopolymer that is selected from the group consisting of xanthan gum, scleroglucone, welan, gelan, and mixtures thereof.

51. The paper coating composition of claim 45, wherein the synthetic polymer is selected from the group consisting of polyacrylamide and polyacrylate.

* * * * *